US006042881A

United States Patent [19]

Ewan

[11] Patent Number: 6,042,881

[45] Date of Patent: Mar. 28, 2000

[54] TEMPORARY TATTOO AND METHOD FOR MANUFACTURING SAME

[76] Inventor: Frederick R. Ewan, 1011 Ocean Ave., Point Pleasant Beach, N.J. 08742

[21] Appl. No.: 09/344,239

[22] Filed: Jun. 25, 1999

Related U.S. Application Data

[62] Division of application No. 08/980,157, Nov. 26, 1997, Pat. No. 5,958,560.

[51] Int. Cl.[7] ..... B41M 3/12; B41J 2/01

[52] U.S. Cl. ..... 427/152; 347/105

[58] Field of Search ..... 347/105; 427/152; 428/211, 354, 914

[56] References Cited

U.S. PATENT DOCUMENTS 5,962,110 10/1999 Penke-Wevelhoff ..... 428/195

*Primary Examiner*—Bruce H. Hess
*Assistant Examiner*—Chris Cronin
*Attorney, Agent, or Firm*—Clifford G. Frayne

[57] ABSTRACT

A temporary tattoo and method for manufacturing same using a printer and a personal computer whereby the paper stock is coated to accept appropriate inks from an ink jet printer to form the design of a temporary tattoo, the paper stock and design being overlaid by an adhesive and release coating for application to the skin of the user, the method allowing for the economical manufacture of small quantities of temporary tattoos of a particular design.

5 Claims, 2 Drawing Sheets

TEMPORARY TATTOO AND METHOD FOR MANUFACTURING SAME

This is a divisional of application Ser. No. 08/980,157, filed Nov. 26, 1997, now U.S. Pat. No. 5,958,560.

BACKGROUND OF THE INVENTION

1. Field of the Invention

The present invention relates to temporary tattoos and more particularly, to a temporary tattoo that is manufactured by an electronic digitized process.

2. Description of the Prior Art

Throughout mankinds recorded history, various means have been used to decorate the human body for a variety of purposes. Today, body decoration is widespread throughout the world from the least to the most advanced technological societies.

Ash, clay, and colorants from plants are used to adorn the human body as a sign of status in society, as a beauty aid, as a decoration, to instill fear in opponents in the times of battle, and for religious purposes. These body decorations were often applied by crude means using sticks and leaves. Little had been known or considered about the safety of these materials. Decoration of the face, fingernails and lips are common throughout the world today, but the materials used for such purposes are closely regulated by many advanced societies because of the potentially hazardous nature of many colorants. Advanced societies recognize the potential skin penetrating toxicity of some of these materials and hence the regulation. Such materials may generate allergic reactions, bacterial infections, and the invasion of the body by toxic substances.

Tattoos have long been a part of these body decorations from the use of heat and metals to burn a design or marking into the skin to the modern needle method wherein non-fugitive dyes and pigments are injected under the skin, but shallow enough to be visible. These tattoos are painful to apply and difficult and costly to remove. For whatever reason they also carried a negative annotation with certain classes of western civilization.

Times have changed with respect to society's acceptance of tattoos. Especially in the 1980s and 1990s tattoos came into favor, especially if tastefully selected and applied to discrete locations on the body. Parents, instead of sneering at their children about even the idea of a tattoo may join them and take on a little design of their own. Tattoo parlors have moved from the seedy side to uptown in many more liberal communities. Part of this change in attitude is due to less painful application of modern needle tattoos. They are now less painful to remove. In addition, temporary tattoos have grown tremendously in popularity with children and some adults. Easy to apply and lasting only a few days, the designers and manufacturers of temporary tattoos have managed a wide array of attractive and interesting designs and broad base popular marketing. Many companies who would not have considered carrying the product a few years ago now sell millions of them as a premium in cereals, ice cream, chewing gum, snack foods and a host of other products. Furthermore, almost every drug store, supermarket and convenience store sells temporary tattoos. The transformation of this product from a transferrable dye of poor quality to a sticker masquerading as a tattoo then to a decal of very high quality has made the product en vogue and enhance the acceptability of permanent tattoos while gaining wide spread popularity for temporary tattoos.

Temporary tattoos today are manufactured either by offset and/or silkscreen conversion in sheet form. Both have gained commercial success. These methods require expensive and time consuming manufacturing of printing plates and conversion on large commercial printing presses for large runs of identical tattoos in order to make the production economical.

Applicant's invention relates to an electronic digitized method for manufacturing temporary tattoos which allows for the temporary tattoos to be custom made and does not require extensive manufacturing processes in order for the manufacture of temporary tattoos to become profitable and economically feasible in small quantities.

OBJECTS OF THE INVENTION

An object of the present invention is to provide for a method for manufacturing a temporary tattoo and the temporary tattoo itself, which permits a customized design.

A still further object of the present invention is to provide for a novel method for the manufacture of temporary tattoos and the temporary tattoo itself which can be designed and manufactured from a personal computer.

A still further object of the present invention is to provide for a novel method for manufacture of a temporary tattoo and the temporary tattoo itself, which conforms to all FDA requirements for application to the body.

SUMMARY OF THE INVENTION

The invention relates to a temporary tattoo for application to the body, however, the product is intended to and may be applied to almost any substrate. The temporary tattoo is manufactured by an electronic digitized process on a personal computer and printed on a paper, the coatings and materials of which conform to all applicable FDA requirements, the printing process taking place by use of an ink jet printer or color laser printer in which the inks also conform to all FDA requirements.

BRIEF DESCRIPTION OF THE DRAWINGS

These and other objects of the present invention will become evident particular when taken in light of the following drawings wherein.

DETAILED DESCRIPTION OF THE DRAWINGS

Figure 1:
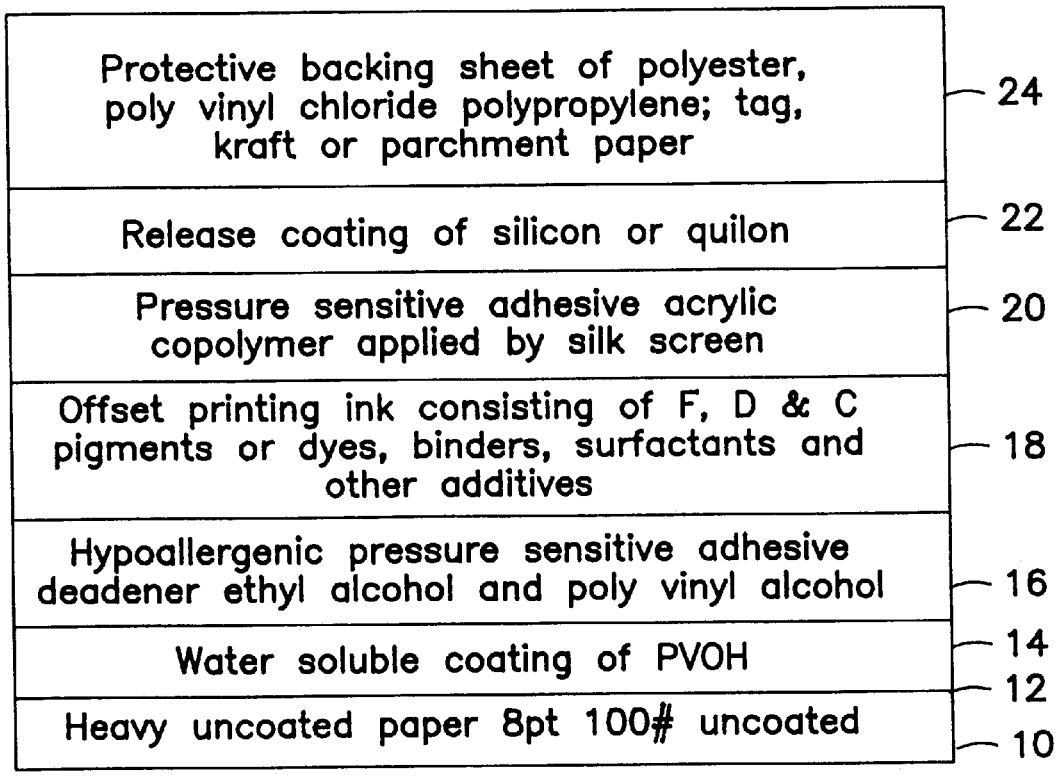
FIG. 1 PRIOR ART
FIG. 1 is a side cutaway view of the prior art comprising temporary tattoos made by the offset or silk screen conversion process.
Figure 2:
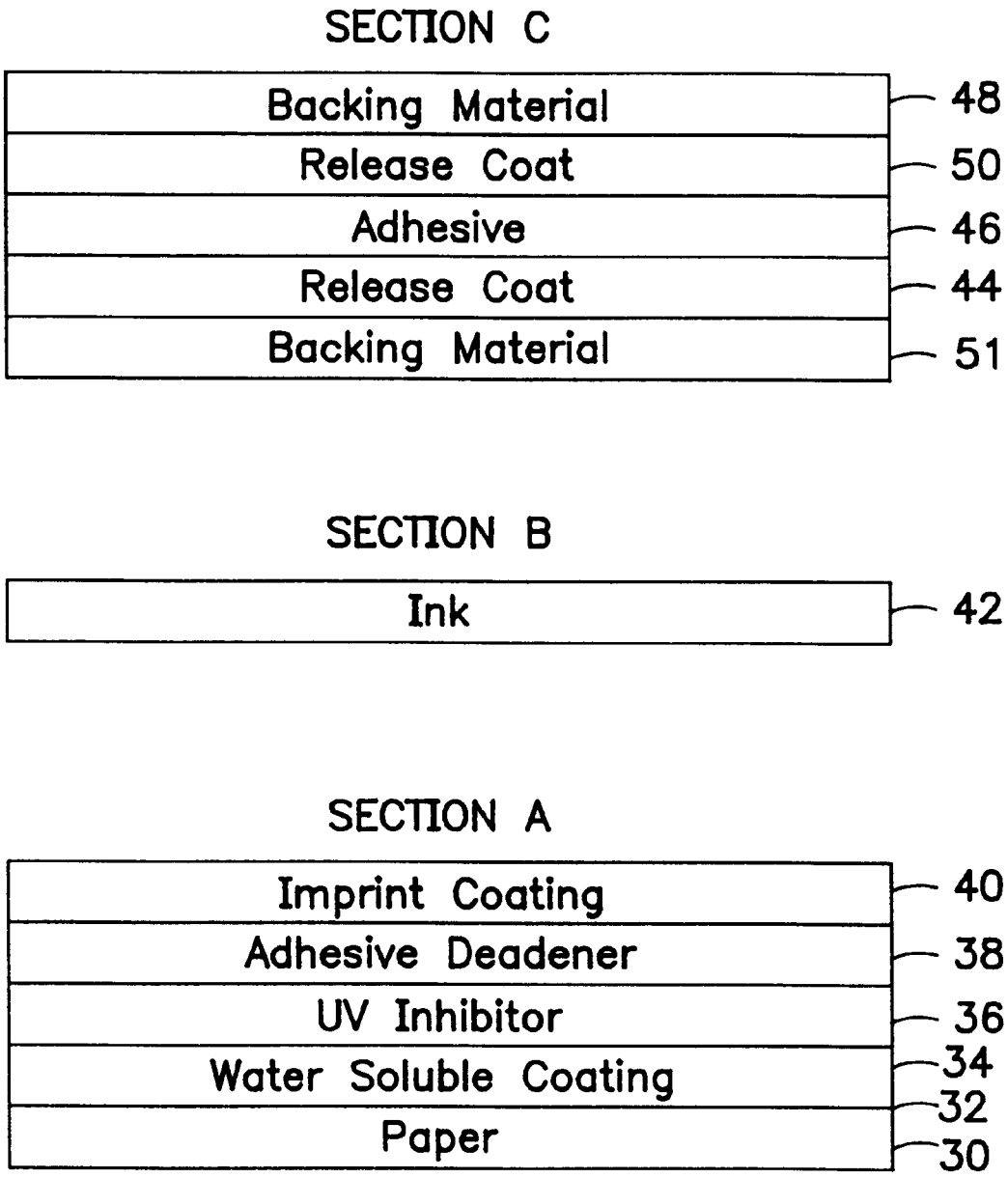
FIG. 2 is a side cross section view of a temporary tattoo manufactured in accordance with the present invention.

FIG. 1 is a cross-sectional view of the stratum utilized to manufacture temporary tattoos by the offset or silk screen conversion format. These methods require expensive and time consuming manufacturing of printing plates and conversion on large commercial printing presses. However, for large runs of temporary tattoos, these methods and the product described hereafter are economical.

The primary layer associated with the temporary tattoo of the types of methods used in manufacturing as indicated above is a paper layer 10 having a fast rate of water transmission such that when a tattoo is applied and placed under water, a quick penetration is possible. Preferrably, the initial paper layer comprises an 8 point 100 pound uncoated paper. This paper layer 10 has a first side referred to in the trade as a wire side 12 which is a rough surface and is easily penetratable by water. The opposing side of paper layer 10 is coated with a water soluble coating such as polyvinyl alcohol (PVOH) 14. A heavy deposition of this coating is desirable so that a smooth surface is formed for printing. The next layer 16, comprises an adhesive deadener which is first printed so that the tattoo has no tack on its outer surface, the outer surface being the surface opposite the skin. Such tackiness is not desirable since it makes the tattoo susceptible to stick to many substrates and effectively lowers the applied life of the product. The adhesive deadener is preferably pressure sensitive and hypoallergenic and is coated in an ethyl alcohol solution of polyvinyl alcohol.

The next layer 18 comprises the tattoo design form through the use of food grade inks, being the same colorants manufactured in compliance with FDA regulated cosmetics. The inks are pigmented and solvent based so that they are not degraded by UV energy from artificial light or the sun. The tattoo design with the inks may be printed by offset, silk screen, or gravure, but for commercial purposes are primarily printed by offset.

A pressure sensitive adhesive layer 20 is then applied, together with a release layer 22 which is applied to protect the adhesive layer until ready for use. The release layer is comprised of either silicon or quilon. Finally, a protective backing sheet 24 is applied in order to protect the product. The protective backing sheet 24 is comprised of polyester, poly vinyl chloride, polypropylene, kraft or parchment paper.

In operation, the user simply removes the protective packing sheet 24 and release coating 22 and applies the pressure sensitive adhesive layer 20 to the skin in the desired location. Water is then introduced to the wire side 12, the water penetrating the paper layer 10, water soluble coating layer 14, and dissolves the water soluble coating. This allows one side of the tattoo paper comprising the ink layer, coating layer and adhesive deadening layer on the skin. This product provides for a temporary tattoo which resembles the permanent variety and which will last for several days. The product is manufactured by the aforesaid process is perfectly acceptable for large commercial runs of tattoos in which the preparation of color separations, printing plates and set up costs for large offset presses are justified.

The current invention simplifies the printing and conversion of temporary tattoos so that they may be computer printed and generated. Laser jet printers cannot print FDA compliance pigments and ink jet printers cannot print solvent based pigmented inks that are UV resistant and not water soluble. This invention utilizes FDA compliance dye inks similar to normal ink jet dyes used in ink jet printers and coupled with a UV inhibiter similar to a suntan oil that protects the tattoo from fading under ultraviolet light. Also included is a thick polyvinyl alcohol film coating that provides water protection for the water soluble ink jet applied dyes and a computer imprintable coating that aids in ink anchoraging.

The product is basically comprised of three sections. A first section A comprises a layer of paper stock 30 having a high rate of water absorption. Preferably the paper stock is 8 mil 100 pound stock. The heavy gauge paper adds stability when coatings are applied. To the smooth side 32 of the paper stock 30 is applied by silk screen printing a water soluble coating 34. This coating is applied in a very thick layer of approximately 0.1 mil or 12 pounds per ream to paper stock 30. The preferred base for this coating 34 is cellulose acetate. The thickness of this coating 34 allows the partial dissolution of the coating when exposed to water and allows it to separate or slide away from the paper stock 30 and for the water soaked paper to be removed leaving the residue from the water soluble coating 34.

Immediately adjacent to the water soluble coating layer 34 is a UV inhibitive layer 36. It is composed of materials that inhibit UV energy from the sun or other sources from bleaching the ink jet dye ink. A useful product for this purpose is a suntan lotion having a PFS rating of 35. A thin, but consistent layer of this coating 36, is applied to the water soluble coating by flexographic printing. This coating is not water soluble so it is not functionally affected by the water dissolution or partial dissolution of the water soluble coating. Immediately adjacent to the UV inhibitive layer coating 36 is a non-water soluble coating 38 referred to as an adhesive deadener, which serves several functions. It prevents the water and water soluble coating from penetrating the ink jet ink and dissolving the colors. It binds the ink jet inks and the remainder of the coatings to the pressure sensitive adhesive 38 so that it does not become tacky once it is applied to the skin. The preferred base for this coating is polyvinyl alcohol. It is a very think and consistent coating of approximately 0.8 mils or 12 pounds per ream of paper stock.

Atop the adhesive deadener layer 40 is a clay based coating 40 that aids in ink jet printing for both drying and ink anchorage. A thin water based coating is used and applied by flexographic printing.

The second section of the temporary tattoo referred to as section B is a series of four process color inks 42, in the colors cyan, magenta, processed blue and black, which have been formulated from F, D, and C dyes that are of the right viscosity.

Electric charge receptivity and dye or pigment size are formulated to flow through various ink jet printers of the type such as a Hewlett Packard 650C or 850C or almost any other ink jet printer or laser jet printer.

In operation, section A is placed on the input tray of such an ink jet printer or laser jet printer and digital art created from software packages, such as Illustrator, Corel Draw, or Word Perfect, are used to generate electronic signals driving the printer to input on Section A, layer 40. Once the inks from section B are imprinted into section A, section C is used to apply the pressure sensitive adhesive required for the temporary tattoo. Such an adhesive is a hypoallergenic and water resistant acrylic copolymer.

In section C a release coating 44 of silicon or quilone is of a lower release level as it relates to and compares to the adhesive layer 46 so that a differential release allows release coating 44 to be removed first from adhesive layer 46. The backing material 48 and 51 may be of any variety of films such as polypropylene, polyester, or polyvinyl alcohol, Kraft or tag paper. A Kraft paper is preferred so as not to add unnecessarily to the cost of the product. Backing 48 is preferably a clear plastic film so that the temporary tattoos may be viewed before purchasing or using same.

The release coating 44 and backing 51 are removed from section C of the temporary tattoo. The adhesive is exposed and may be laminated by hand or mechanically to sections A and B. Cut to size the product is now a temporary tattoo.

The remaining backing sheet 48 and second release coating 50 are removed exposing the adhesive layer 46 which may be applied to the skin along with sections A and sections B. The paper is then exposed to running water from 2 to 10 seconds and the paper stock 30 is removed leaving the balance of section A, section B, plus the adhesive section 46 of section C.

The tattoo manufactured and applied in accordance with the this methodology will last from 3 to 5 days in water resistant. It may be removed at any time using baby oil or scrubbing with soap and water.

As an example of the process, a temporary tattoo was generated using a layer of paper stock 30 referred to in the trade as a skin cal twin wire tattoo paper. This is a heavy, dimensionally stable paper suitable for applying coatings and exposure to heat. To this paper stock 10 was applied a water soluble coating 34, namely cellose acetate by a silk screen method, a UV inhibiter 36, by flexographic process, and an adhesive deadener 38 again by a silk screen process.

Independently, Section C, comprising adhesive 46 sandwiched between release coat 44 and backing material 51; and release coat 50 and backing material 48 are laminated in sheet form.

Section A, of the paper stock 10 with the aforesaid coatings was then inserted into the input trap of a Hewlett Packard 850C ink jet printer. The printer had ink cartridges loaded with FDA approved, F, D and C inks (section B). A scanner was then utilized to digitize a picture which was then imported into an Adobe Illustrator program previously loaded into a personal computer. The computer was then commanded to imprint the image using the ink jet inks, 42, loaded into the printer cartridges. The subsequent print out was then over laminated with section C and the temporary tattoo was then cut to size.

It will be recognized by those of ordinary skill in the art, that other suitable ink jet printers may be utilized with this process as well as any one of a number of personal computers as well as available software without departing from the spirit and scope of the invention.

The development of these various laminated sections allows for sections A and C to be prepared in bulk, and then for the operator to selectively select the design of the tattoo and quickly and economically print the tattoo and laminate sections A and C thus arriving at a finished product. In this manner, selective and original temporary tattoos which would be cost prohibitive under normal production procedures, can be produced quickly and economically with very little waste.

While the present invention has been described in conjunction with the exemplary embodiment thereof, it will be understood that many modifications will be apparent to those of ordinary skill in the art and the applications intended to cover any adaptations or variations thereof. Therefore it is manifestly intended that the invention be only limited by the claims and equivalents thereof.

What is claimed is:

1. A method for generating a temporary tattoo comprising the steps of:

a. coating a first stratum of paper stock with a water soluble coating wherein said first stratum of paper stock has a high rate of water transmission and is susceptible for accepting and drying various coatings;

b. overlaying said water soluble coating with a UV resistant coating;

c. overlaying said UV resistant coating with an adhesive deadener;

d. overlaying said adhesive deadener with an imprint coating capable of accepting a plurality of different inks;

e. loading a printer with FDA approved inks;

f. digitizing a desired image into a computer, said computer connected to said printer;

g. inputting said stratum of paper stock and coatings into said printer and printing said digitized image on said imprint coating by use of said inks in said printer;

h. applying an adhesive coating having a release coating and backing material over said printed coatings.

2. The method in accordance with claim 1 wherein a temporary tattoo produced according to claim 1 is cut to size.

3. The method in accordance with claim 1 wherein said printer is an ink jet printer.

4. The method in accordance with claim 1 wherein said printer is a laser jet printer.

5. A temporary tattoo made in accordance with the method according to claim 3 or 4.

* * * * *